United States Patent [19]

Bugg

[11] Patent Number: 4,695,835

[45] Date of Patent: Sep. 22, 1987

[54] DATA DISPLAY SYSTEMS

[75] Inventor: Richard E. F. Bugg, Coulsdon, England

[73] Assignee: U.S. Philips Corporation, New York, N.Y.

[21] Appl. No.: 552,654

[22] Filed: Nov. 17, 1983

[30] Foreign Application Priority Data

Nov. 19, 1982 [GB] United Kingdom ..... 8233114

[51] Int. Cl.[4] ..... G09G 1/16

[52] U.S. Cl. ..... 340/750; 340/735; 340/728

[58] Field of Search ..... 340/750, 731, 735, 728

[56] References Cited

U.S. PATENT DOCUMENTS

| | | | |
|---|---|---|---|
| 3,893,100 | 7/1975 | Stein | 340/731 |
| 3,896,428 | 7/1975 | Williams | 340/731 |
| 3,996,584 | 12/1976 | Plager | 340/790 |
| 4,107,786 | 8/1978 | Masaki et al. | 340/731 |
| 4,163,229 | 7/1979 | Bodin et al. | 340/735 |
| 4,241,340 | 12/1980 | Raney, Jr. | 340/731 |
| 4,375,079 | 2/1983 | Ricketts et al. | 340/724 |
| 4,400,697 | 8/1983 | Currie et al. | 340/711 |
| 4,429,306 | 1/1984 | Macauley et al. | 340/735 |
| 4,439,761 | 5/1984 | Fleming et al. | 340/735 |

*Primary Examiner*—Marshall M. Curtis

*Attorney, Agent, or Firm*—Robert T. Mayer; Bernard Franzblau

[57] ABSTRACT

Apparatus for addressing a character memory of a data display system in which displayed data is composed of discrete characters the shapes of which are determined by selected dots of a dot matrix. When character information conforms to different character modes of the form m×n×b, where m×n is a bit matrix format which is repeated b times to provide b-bits per displayed character dot, the stored character information includes mode bits which identify the mode. These mode bits are read out by logic control and addressing means by a first address and are used to determine a second address which varies according to the size of the mode and how many bit patterns it contains. The two addresses select all of the dot information required for the display of characters in real time.

12 Claims, 4 Drawing Figures

| | MODE | CHAR | MODE | CHAR |
|---|---|---|---|---|
| | b15 b14 b13 b12 b11 b10 | b9 b8 b7 b6 b5 b4 | b3 b2 b1 b0 | |
| W0 | B 0 | | B 1 | |
| W1 | B 2 | | B 3 | |
| W2 | B 4 | | B 5 | |
| W3 | " 6 | | " 7 | |
| W4 | " 8 | | " 9 | |
| W5 | " 10 | | " 11 | |
| W6 | " 12 | | " 13 | |
| W7 | " 14 | | " 15 | |
| W8 | " 16 | | " 17 | |
| W9 | " 18 | | " 19 | |

DATA DISPLAY SYSTEMS

BACKGROUND OF THE INVENTION

This invention relates to data display systems of a type for displaying data represented by digital codes, the displayed data being composed of discrete characters the shapes of which are defined by selected dots of a dot matrix which constitutes a character format for the characters.

DESCRIPTION OF THE PRIOR ART

Data display systems of the above type are used in a variety of different applications for displaying data on the screen of a CRT (cathode ray tube) or other raster scan display device. One such data display system, for instance, is used in conjunction with telephone data services which offer a telephone subscriber having a suitable video terminal the ability to gain access via the public telephone network to a data source from which data can be selected and transmitted to the subscriber's premises for display. Examples of this usuage are the British and German videotex services Prestel and Bildschirmtext.

A data display system of the above type includes, in addition to the CRT or other raster scan display device, acquisition means for acquiring transmission information representing data selected for display, memory means for storing digital codes derived from the transmission information, and character generator means for producing from the stored digital codes character generating signals for driving the display device to produce the data display.

It is known for the character generator means to include a character memory in which is stored character information identifying the available character shapes which the arrangement can display. This character information is addressed selectively in accordance with the stored digital codes and the information read out is used to produce the character generating signals for the data display. This selective addressing is effected synchronously with the scanning action of the display device, which scanning action may be effected with or without field interlacing.

To facilitate this selective addressing, it is convenient to store the character information that identifies the patterns of discrete dots which define the character shapes as corresponding patterns of data bits in respective character memory cell matrices. With this form of storage, the dot pattern of a character shape as displayed on the display device can have a one-to-one correspondence with the stored bit pattern for the character.

In order to further facilitate the aforesaid selective addressing, it is also convenient to display characters of a standard size arranged in character rows, which can contain up to a fixed number of characters. This standardization determines the size for a rectangular character display area, composed of a plurality of dot rows, which is required for displaying one character. For certain character shapes, for instance alpha-numeric characters, the resolution required to display these character shapes within a character display area require the aforesaid one-to-one correspondence. However, for other character shapes which require less resolution for their display, for instance the shapes of so-called graphics characters which can be used to display simple diagrams and mosaics rather than text, the corresponding stored bit patterns need not conform to the one-to-one correspondence, provided that the addressing of these latter stored bit patterns is suitably modified so as to be effected on a multiple basis to read-out and display the character dots a number of times in the character display area. As a result, such other character shapes require less memory for their storage. Thus, the character memory may comprise a first memory portion containing the bit patterns for a first set of character shapes which are all alpha-numeric characters requiring the one-to-one correspondence for their display, and a second, smaller, memory portion containing the same number of bit patterns for a second set of character shapes which are all graphics characters not requiring the one-to-one correspondence.

A specific form of data display system in which both alpha-numeric and graphics characters can be displayed selectively on the screen of a television receiver is disclosed in United Kingdom Patent Specification No. 1 461 929, with reference to data transmission systems of the television broadcast type, such as disclosed in United Kingdom Patent Specification No. 1 370 535, in which digital codes for data display are multiplexed on a broadcast television signal.

With a view to extending the display facilities of a data display system of the type being considered, it has been proposed to provide a choice of more than 2 colors for displayed characters. For this proposal, more than a single stored data bit is required for each dot of a character in order to encode the color choice so that, in effect, the stored character information for a character will consist of more than one bit pattern.

The character bit patterns of different size and multiplicity will be considered hereinafter as pertaining to different character modes which are identifiable according to their size and multiplicity. For instance, an $m \times n \times b$ character mode has a bit matrix format containing $m \times n$ bits which is repeated b times to provide b-bits per displayed character dot of the character shape concerned. Thus, b is the number of bits used to define each display dot. The information contained within character bit patterns which together define a character mode is (a) character shape, (b) character resolution for a given character size, and (c) character color.

The combination of stored bit patterns of different size and of stored multiple bit patterns, for various character shapes, poses the problem of addressing the character memory in real time to obtain the required information for character display, without having to use a fast and thus expensive memory device for the character memory.

It is one object of the present invention to provide, in a data display system of the type referred to, a means of storing and addressing character information for characters having different character modes as set forth above so as to mitigate this problem.

Also, with a view to extending the display facilites of a data display system of the type being considered, various proposals have been made for increasing the number of character shapes which are available for selection to form a display. One such proposal is merely to increase the size of the character memory to accommodate additional fixed character sets. Another such proposal is to provide the system with a number of so-called "dynamically redefinable character sets" (DRCS), which are available at a data source from which they can be transmitted selectively to the system for temporary storage and use therein in the same way as a fixed character set. With this latter proposal, less additional ("random-access") memory would be needed, compared with the amount of ("read-only") memory that would otherwise be required for storing permanently the bit patterns for a given number of character sets.

It is necessary for display purposes to identify the character mode of stored DRCS characters, and it is convenient for this purpose to store the mode information as part of the character information and to read it out when addressing the relevant memory location. However, the aforesaid problem of addressing in real time then becomes more acute because the mode information is not known in advance.

The means for storing and addressing character information which the present invention proposes also seeks to mitigate this aspect of the problem.

SUMMARY OF THE INVENTION

According to the invention, a data display system of the type referred to, having a character memory in which is stored character information which conforms to different character modes of the form $m \times n \times b$, where $m \times n$ is a bit matrix format which is repeated b times to provide b-bits per displayed character dot of the characters concerned, is characterized in that the stored character information for each character includes mode bits which determine the character mode, that these mode bits are read out by logic control and addressing means when using a first address for selecting for a character dot row dot information contained in one bit matrix for the mode, and that these mode bits are used by said logic control and addressing means to determine a second address for selecting further dot information for the same character dot row in the same or a second bit matrix for the mode.

In carrying out the invention, the addressing is preferably so organized that the first address has the same address format irrespective of the relative sizes of the $m \times n \times b$ character modes.

In order that the character memory can be accessed in real time for displaying characters, the character memory has the character bit patterns of different character modes stored therein in such a manner that for any character mode the two data fetches which are effected by the first and second addresses obtain all the information required for the display.

Conveniently, the character memory has a character cell size of $x \times y$ elemental storage areas, the y-rows of x-areas providing storage for respective data words each consisting of a number of bytes which can contain character information for either one or more than one character within the word, the entire number of bytes of a word being read out by the relevant address and means being provided to select, when appropriate, from which byte the character information is to be used.

In a particular application of the invention which is envisaged, $x=16$ and $y=10$, each data word contains two bytes and there are three possible character dot matrix sizes $12 \times 10$, $6 \times 10$, and $6 \times 5$, of which the first has the dot information for a character dot row defined in both bytes of a data word, whereas the second and third each has the dot information for a character dot row defined in only one or both bytes of a data word, each byte of a data word also containing two mode bits by which the character mode is identified. With each of these different dot matix sizes, there can be one or more bit patterns to form the different character modes.

BRIEF DESCRIPTION OF THE DRAWINGS

In order that the invention may be more fully understood reference will now be made, by way of example, to the accompanying drawings, in which:

FIG. 1 shows diagrammatically a video display terminal having a data display system in which the invention can be embodied; and FIGS. 2 to 4 are diagrams illustrating the storage of character bit patterns in a character memory for the purposes of the invention wherein;

FIG. 2 shows diagrammatically the composition of a character memory cell;

FIG. 3 shows diagrammatically the storage of character information for seven DRCS character modes P-V; and;

FIG. 4 illustrates the addressing for mode U of FIG. 3.

Figures 1, 2:
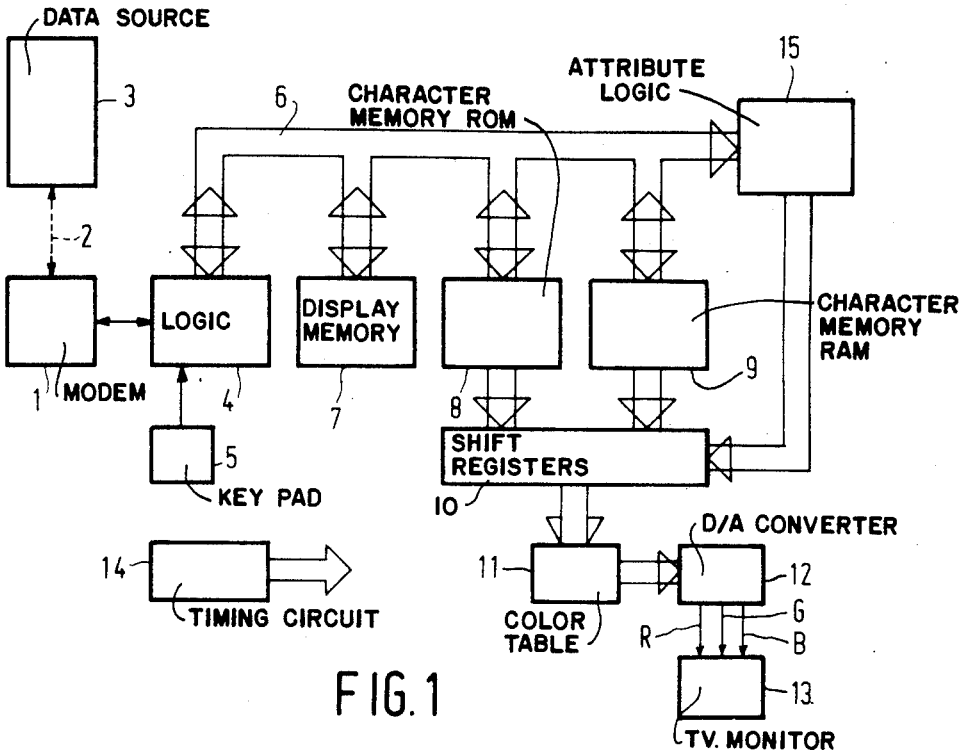

Referring to the drawings, the video display terminal shown in FIG. 1 comprises a modem 1 by which the terminal has access over a telephone line 2 (e.g. via a switched public telephone network) to a data source 3. A logic and processor circuit 4 provides the signals necessary to establish the telephone connection to the data source 3. The circuit 4 also includes data acquisition means for acquiring transmission information from the telephone line 2. A command key pad 5 provides user control instructions to the circuit 4. A common address/data bus 6 interconnects the circuit 4 with a display memory 7, a fixed character memory 8 (ROM) and a DRCS character memory 9 (RAM). Under the control of the circuit 4, digital codes derived from the received transmission information and representing characters for display are loaded onto the data bus 6 and assigned to appropriate locations in the display memory 7 as display information. Thereafter, addressing means in the circuit 4 accesses the display data stored in the display memory 7 and uses it to address the character memories 8 and 9, as appropriate, to produce character dot information. Shift registers 10 receive this character dot information and use it to drive a color look-up table 11 to produce therefrom digital color codes which are applied to a digital-to-analog converter 12. The output signals from the converter 12 are the RGB character generating signals required for driving a television monitor 13 to display on the screen thereof the characters represented by the display data. A timing circuit 14 produces the timing control for the data display system.

The digital codes which represent the characters to be displayed include or imply information as to so-called display attributes which are used to modify the representation of character shapes, for instance as to color, or by flashing or underlining. The attribute information also indicates whether a digital code for a character pertains to a character in the character memory 8 or in the DRCS character memory 9.

There is included in the data display system, attribute logic 15 which contains control data relating to the different display attributes. The circuit 4 is responsive to the stored attribute information to initiate the relevant attribute control by the attribute logic 15, to implement the attributes concerned for the character display.

The character memory 9 which is used for DRCS can be organized in accordance with the invention so as to make available the character information stored therein in real time during the display process. For the purpose of describing this organization the following criteria will be assumed, although it will be apparent that other criteria are possible within the scope of the invention.

The display on the screen of the television monitor of a single character uses a dot matrix of 12×10 character dots in a character display area which is 10 television lines high (V) and 1 us of line scan wide (H). A standard 625-line television raster scan is assumed.

The DRCS memory 9 is composed of a number of sections or "chapters" each of which comprises 16K bits of memory which are considered as one thousand and twenty-four 16-bit words each of which contains two 8-bit bytes. A character memory cell consists of ten words each of which contains 12 bits of dot information and four bits of mode information.

There are seven different DRCS character modes P to V as shown in the following Table 1

TABLE 1

| | H | V | bits per pixel or character dot | total number of characters per chapter |
|---|---|---|---|---|
| P | 12 | 10 | 1 | 102 |
| Q | 12 | 10 | 2 | 51 |
| R | 6 | 10 | 1 | 2 × 102 |
| S | 6 | 10 | 2 | 102 |
| T | 6 | 10 | 4 | 51 |
| U | 6 | 5 | 2 | 2 × 102 |
| V | 6 | 5 | 4 | 102 |

Therefore, a single chapter of memory of the DRCS memory 9 has a capacity for storing the character information for total numbers of characters of each of the seven DRCS character modes as given in the last column of the Table 1.

FIG. 2 shows diagrammatically the composition of a character memory cell. This cell has 16 bit positions B0 to B15 of which the positions B6, B7, B14 and B15 are for mode bits and the remaining positions B0 to B5 and B8 to B13 are for character dot bits. The cell has ten rows of bit positions for containing ten 16-bit words (WORD 0 to WORD 9). Each word is composed of two of the twenty 8-bit bytes (BYTE 0 to BYTE 19) as indicated.

Figure 3:
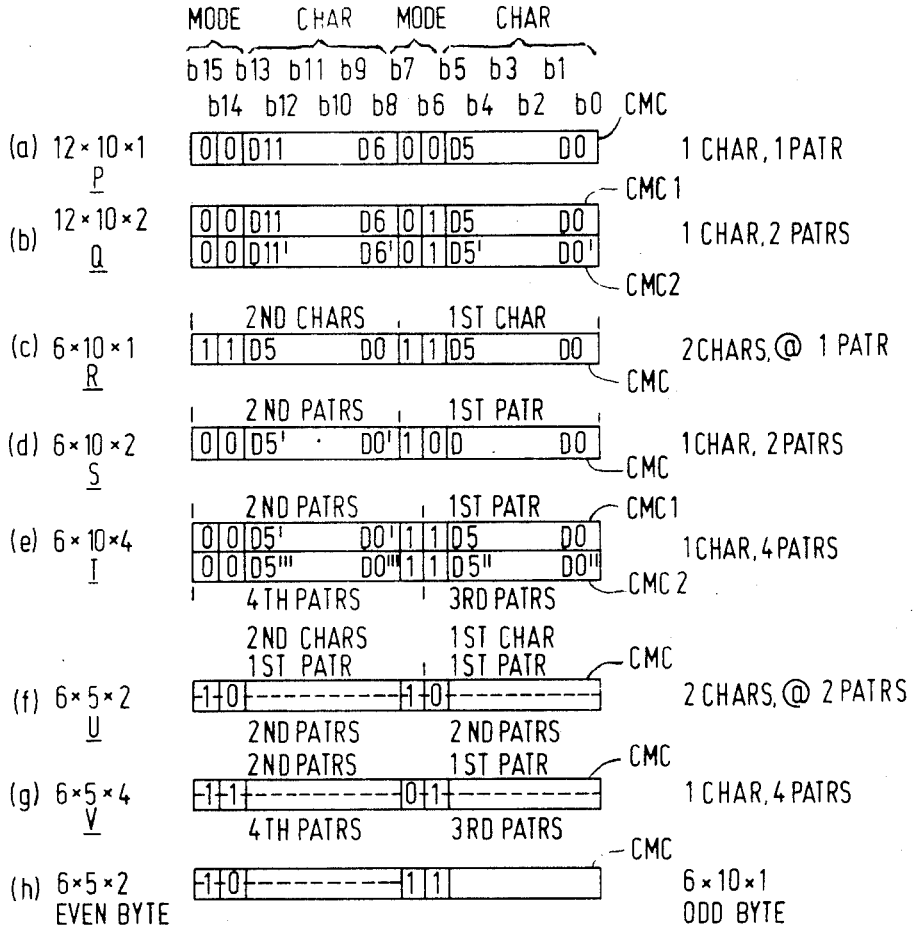

FIG. 3 shows diagrammatically the manner in which the character information for a character of each of the seven DRCS character modes P to V is stored in the DRCS memory 9. FIG. 3*a* shows that a 12×10×1 mode (P) character requires a single cell CMC for its storage. In each of the ten words of the cell the relevant 12 bits D0 to D5 and D6 to D11 of dot pattern information for the character are stored in bit positions B0 to B5 and B8 to B13, and the mode information is stored in the bit positions B6, B7 and B14, B15. FIG. 3*b* shows that a 12×10×2 mode (Q) character requires two memory cells CMC1 and CMC2 for storing its dot pattern information. One set of 12 bits D0 to D11 is stored in the cell CMC1, and the other set of 12 bits D0' to D11' is stored in the cell CMC2. The four bits of mode information are stored in each cell in the mode bit positions.

FIGS. 3*c* to 3*g* show the storage techniques for the other character modes having smaller dot matrices. In FIG. 3*c*, the respective sets of 6 bits D0 to D5 of character dot information for two 6×10×1 mode (R) characters are stored in a single cell CMC along with the mode information bits. in FIGS. 3*d*, the two sets of 6 bits of character dot information for a single 6×10×2 mode (S) character are stored in a single cell CMC along with mode information bits. In FIG. 3*e*, the four sets of 6 bits of character dot information for a single 6×10×4 mode (T) character are stored in two cells CMC1 and CMC2 along with mode information bits. In FIG. 3*f*, the two sets of 6 bits of character dot information for a first 6×5×2 mode (U) character are stored in the first half of a single cell CMC, and the two sets of 6 bits of character dot information for a second 6×5×2 mode (U) character are stored in the second half of the single cell CMC, along with mode information bits. In FIG. 3*g*, the four sets of 6 bits of character dot information for a single 6×5×4 mode (V) character are stored in a single cell CMC, along with mode information bits. As shown in FIG. 3*h*, the possibility also exists for storing the respective sets of bits of character dot information for two characters having different modes in a single cell CMC. In this Figure, a 6×5×2 mode (U) character and a 6×10×1 mode (R) character are involved, but other combinations are possible. FIGS. 3*a*–3*h* indicate that, depending on the character mode, there are 1, 2 or 4 bit patterns per character. And, depending on its size, a bit pattern can occupy all or only a part of the character memory cell. FIGS. 2 and 3 together show that the display of one character dot row requires the bits in ½, 1 or 2 words, depending on the character mode, whereas the display of an entire character requires the bits in n times the number of words.

This technique for storing the character dot information for different character modes enables the display information for 1 micro-second of the display of any character to be obtained by addressing the DRCS memory 9 only twice, the addressing fetching one whole 16-bit word in each read cycle. Each of the two fetches obtain one 16-bit word stored in the DRCS memory. The addressing or read cycle rate is then only 2 Mz for the assumed character rate of 1 Mz, giving a 500 ns clock rate for the DRCS memory 9 which is sufficiently slow for practical purposes. The character modes Q, T and V actually require two read cycles for 24 data bits to be fetched for each 1 micro-second of the display. The character mode U requires two read cycles for 12 data bits to be fetched. The other character modes require only 12 data bits (plus mode bits) to be fetched in a single read cycle, except for mode R which requires only 6 data bits to be fetched.

Therefore, in principle, a single read cycle would suffice for these other modes. However, because the character modes Q, T, U and V require the two read cycles with two separate addresses for fetching their display information from the DRCS memory 9, the above storage technique is proposed in accordance with the invention so as to permit an addressing format which uses two read cycles with separate addresses to fetch the display information for the other character modes as well. By doing this, the same addressing format can be used for the first addressed word, irrespective of which character mode is being addressed. The second addressed word, if any, which will of course be in a different location for the different character modes, is then determined from the mode bits which are read out in the first addressed word.

In FIG. 3, the mode bits are allocated 0 and 1 values for the different character modes as set forth in Table II below.

TABLE II

| | Mode | B15 | B14 | B7 | B6 |
|---|---|---|---|---|---|
| P | 12 × 10 × 1 | 0 | 0 | 0 | 0 |
| Q | 12 × 10 × 2 | 0 | 0 | 0 | 1 |

TABLE II-continued

| | Mode | B15 | B14 | B7 | B6 |
|---|---|---|---|---|---|
| R | 6 × 10 × 1 | 1 | 1 | 1 | 1 |
| S | 6 × 10 × 2 | 0 | 0 | 1 | 0 |
| T | 6 × 10 × 4 | 0 | 0 | 1 | 1 |
| U | 6 × 5 × 2 | 1 | 0 | 1 | 0 |
| V | 6 × 5 × 4 | 1 | 1 | 0 | 1 |

These mode bits provide the following information in the addressing operation of the DRCS memory 9, when they have been read out in the first addressed word.

B15=0 means go on 20 bytes for the second addressed word (or no second word).

B15=1 means go on ±2 bytes for even and odd display lines, respectively, (or no second word).

B15, B7=11 means only ½a cell is used for a character, and B6 and B14 indicate which character mode is involved.

Since each read cycle fetches a word of two 8-bit bytes, whereas an addressing operation is required to fetch the display information in only one of these two bytes for certain character modes, the selection of the relevant byte becomes necessary in this situation. The selection can readily be achieved by arranging for character modes R and U, which are stored in only half a memory cell, that either the odd 8-bit byte or the even 8-bit byte is selected in accordance with the value of a bit of attribute information for the character concerned in the display memory 7.

The addressing format for the first address for each character mode can be represented as $(K+2(10\times C+L))$ which equals $K+20\times C+2L$. In this first address K is the chapter offset relative to the start of the whole DRCS memory 9, C is the character code number and L is the line number in the character code. The factor of 2 in the first address occurs because address calculations are all assumed to relate to byte addresses, whereas each address reads out a whole word consisting of two bytes.

Table III below gives the first and second address requirements for each of the seven character modes P to V, based on the mode bit information as already given in Table 11 for the different modes.

TABLE III

| | Mode | 1st Address | 2nd Address |
|---|---|---|---|
| P | 12 × 10 × 1 | K + 20C + 2L | — |
| Q | 12 × 10 × 2 | " | 1st + 20 |
| R | 6 × 10 × 1 | " | — |
| S | 6 × 10 × 2 | " | — |
| T | 6 × 10 × 4 | " | 1st + 20 |
| U | 6 × 5 × 2 | " | 1st ± 2 |
| V | 6 × 5 × 4 | " | 1st ± 2 |

In practice, these addresses would, of course, be in binary coded form. Assuming a first address for, say line 4 of a character code stored as code 3 in a chapter K=0, the addressing operation is as follows depending on which character mode the particular character stored as this code 3 has. In each case the first address is $0+(20\times 3)+(2\times 4)=68$. This first address will fetch the data from word 4 of the relevant character memory cell. For modes P, R and S no second address is necessary. For mode Q, the second address will be $68+20=88$, as determined from the mode bits, which fetches the data from word 4 of the immediately following character memory cell. For mode T, the second address will also be 88. For modes U and V, the second address is $68+2=70$ for obtaining the character dot information, because an even display line is involved.

Figure 4:
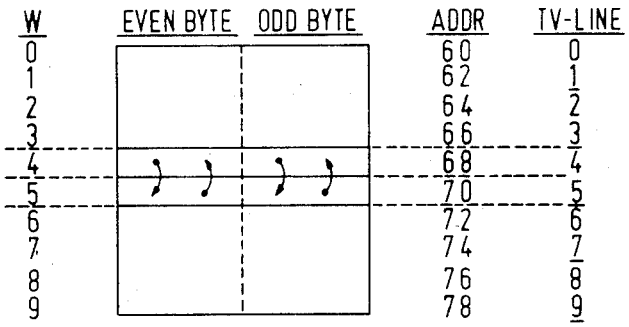

This addressing for mode U is illustrated in FIG. 4. For the television display line 4, the dot information is obtained from word 4 which is addressed by first address 68. Either the even byte or the odd byte is selected as determined by the value of a bit of attribute information for the character. The second address 70 then obtains the dot information from word 5 and the relevant byte is again selected. The mode and display information in these two bytes are then used to produce the display on television display line 4. For the television display line 5 the dot information is obtained from word 5 which is addressed by a first address which is now 70, and one byte is chosen as before. Since the character pattern for the mode has a 6×5 dot format, the same dot information is required for both lines 4 and 5 of the display. Therefore, the second address for display line 5 is $70-2=68$. Thus, words 4 and 5 are fetched and used for line 4, and words 5 and 4 are fetched and used for line 5. A similar addressing operation is used for mode V, except that both even and odd bytes are used because 4 groups of 6 bits have to be fetched for each television display line.

The invention thus provides a convenient means of memory addressing in real time for obtaining different amounts of data.

I claim:

1. A data display system for displaying data represented by digital codes, the displayed data being composed of discrete characters the shapes of which are determined by selected dots of a dot matrix which constitutes a character format for the characters, said system comprising a character memory which stores character information which conforms to different character modes of the form m×n×b, where m×n is a bit matrix format which is repeated b times to provide b-bits per displayed character dot of the characters concerned, said system being characterized in that the stored character information for each character includes more bits which determine the character mode and include (a) character shape, (b) character resolution for a given character size, and (c) character color, and logic control and addressing means are provided for reading out from a first address said mode bits along with dot information for a selected character dot row contained in one bit matrix for the mode and wherein said mode bits are used by said logic control and addressing means to determine a second address for selecting further dot information for the same character dot row in the same or a second bit matrix for the mode, the addressing being organized so that the first address has the same address format irrespective of the relative sizes of the m×n×b character modes.

2. A data display system as claimed in claim 1, characterized in that the character memory has character bit patterns of different character modes stored therein in such a manner that for any character mode two data fetches are effected by the first and second addresses to obtain all of the information required for a character display.

3. A data display system as claimed in claim 1, characterized in that the character memory has a character cell size of x×y elemental storage areas with y-rows of x-areas providing storage for respective data words each comprising a number of bytes which can contain character information for one or more characters within a data word, the entire number of bytes of a word being readable by a relevant address, and means for selecting, when appropriate, from which bytes the character information is to be used.

4. A data display system as claimed in claim 3, characterized in that $x=16$ and $y=10$, each data word contains two bytes and there are first, second and third possible character dot matrix sizes of $12\times10$, $6\times10$, and $6\times5$, of which the first has the dot information for a character dot row defined in both bytes of a data word, whereas the second and third each has the dot information for a character dot row defined in only one or both bytes of a data word, each byte of a data word also containing two mode bits by which the character mode is identified.

5. A data display system as claimed in claim 1, characterized in that the character memory has character bit patterns of different character modes stored therein in a manner such that for any character mode two data fetches are effected by the first and second addresses to obtain all of the information required for a character display.

6. A data display system as claimed in claim 1, characterized in that the character memory has a character cell size of $x\times y$ elemental storage areas with y-rows of x-areas providing storage for respective data words each comprising a number of bytes which can contain character information for either one or more than one character within a word, the entire number of bytes of a word being readable by a relevant address, and means for selecting, when appropriate, from which byte the character information is to be used.

7. A data display system as claimed in claim 2, characterized in that the character memory has a character cell size of $x\times y$ elemental storage areas with y-rows of x-areas providing storage for respective data words each comprising a number of bytes which can contain character information for either one or more than one character within a word, the entire number of bytes of a word being readable by a relevant address, and means for selecting, when appropriate, from which byte the character information is to be used.

8. A data display system as claimed in claim 6, characterized in that $x=16$ and $y=10$, each data word contains two bytes and there are first, second and third possible character dot matrix sizes of $12\times10$, $6\times10$, and $6\times5$, of which the first has the dot information for a character dot row defined in both bytes of a data word, whereas the second and third each has the dot information for a character dot row defined in only one or both bytes of a data word, each byte of a data word also containing two mode bits by which the character mode is identified.

9. A data display system as claimed in claim 7, characterized in that $x=16$ and $y=10$, each data word contains two bytes and there are first, second and third possible character dot matrix sizes of $12\times10$, $6\times10$, and $6\times5$, of which the first has the dot information for a character dot row defined in both bytes of a data word, whereas the second and third each has the dot information for a character dot row defined in at least one of the two bytes of a data word, each byte of a data word also containing two mode bits by which the character mode is identified.

10. A method of addressing a character memory of a data display system in which displayed data is composed of discrete characters the shapes of which are determined by selected dots of a dot matrix providing a character format for the characters, said method comprising the following steps: storing in said character memory character information which conforms to different characters modes of the form $m\times n\times b$, where $m\times n$ is a bit matrix format which is repeated b times to provide b-bits per displayed character dot of the characters concerned, wherein the stored character information for each character includes mode bits which identify the character mode, and reading out said mode bits by means of logic control and addressing means via a first address, said mode bits identifying a second address which varies according to the size of the mode and the number of bit patterns it contains, whereby the first and second addresses select all of the dot information required to display characters in real time.

11. A method as claimed in claim 10 wherein the first address has the same address format irrespective of the relative sizes of the $m\times n\times b$ character modes.

12. A method as claimed in claim 10 wherein the character memory stores the character bit patterns of different character modes such that for any character mode two data fetches effected by the first and second addresses provide all of the information required for a character display.

* * * * *

UNITED STATES PATENT AND TRADEMARK OFFICE

CERTIFICATE OF CORRECTION

PATENT NO. : 4.695.835

DATED : September 22. 1987

INVENTOR(S) : Richard E. F. Bugg

It is certified that error appears in the above-identified patent and that said Letters Patent is hereby corrected as shown below:

Claim 1. line , 13 change "more" to --mode--

Signed and Sealed this

Seventeenth Day of January, 1989

*Attest:*

*Attesting Officer*

DONALD J. QUIGG

*Commissioner of Patents and Trademarks*